US007121021B2

(12) United States Patent
Sakai

(10) Patent No.: US 7,121,021 B2
(45) Date of Patent: Oct. 17, 2006

(54) SNOW REMOVAL MACHINE

(75) Inventor: Seishu Sakai, Wako (JP)

(73) Assignee: Honda Motor Co., Ltd., (JP)

( * ) Notice: Subject to any disclaimer, the term of this patent is extended or adjusted under 35 U.S.C. 154(b) by 0 days.

(21) Appl. No.: 10/762,092

(22) Filed: Jan. 21, 2004

(65) Prior Publication Data

US 2004/0172860 A1 Sep. 9, 2004

(30) Foreign Application Priority Data

Jan. 21, 2003 (JP) ..... 2003-012844
Jan. 21, 2003 (JP) ..... 2003-012853
Aug. 20, 2003 (JP) ..... 2003-208119

(51) Int. Cl.
*E01H 5/09* (2006.01)

(52) U.S. Cl. ..... 37/251; 37/256; 37/259; 37/233

(58) Field of Classification Search ..... 37/256, 37/259, 260, 262, 251, 252, 242, 233
See application file for complete search history.

(56) References Cited

U.S. PATENT DOCUMENTS 1,789,874 A * 1/1931 Lilly ..... 198/642
2,307,412 A * 1/1943 Lewis ..... 37/285
2,549,043 A * 4/1951 Arthur ..... 451/466
3,015,172 A * 1/1962 Parnas ..... 37/256
3,805,421 A * 4/1974 Kamlukin et al. ..... 37/233
4,158,923 A * 6/1979 Steiner et al. ..... 37/256
4,360,983 A * 11/1982 Krug ..... 37/233
4,765,073 A 8/1988 Cloutier ..... 37/237
5,127,174 A * 7/1992 Takeshita ..... 37/250

FOREIGN PATENT DOCUMENTS

DE 3436562 A1 * 4/1986
JP 03137311 6/1991

* cited by examiner

*Primary Examiner*—Victor Batson
(74) *Attorney, Agent, or Firm*—Adams & Wilks

(57) ABSTRACT

A snow removal machine of this invention has a blower provided in a blower housing for throwing up snow collected by an auger toward a chute. The blower has a plurality of supporting members provided on a drive shaft for rotating the auger and the blower and a plurality of throwing-up blades attached to the respective supporting members. The throwing-up blades are elastically deformable. A vacant space is formed between the supporting members and the throwing-up blades. The vacant space allows deformation of the throwing-up blades in a direction opposite to the rotation direction of the blower.

5 Claims, 15 Drawing Sheets

SNOW REMOVAL MACHINE

FIELD OF THE INVENTION

The present invention relates to a snow removal machine and, more particularly, to an improvement in a blower for throwing up snow collected by an auger toward a chute for throwing the snow through the chute onto a desired location.

BACKGROUND OF THE INVENTION

Snow removal machines with an auger unit including a blower for removing snow accumulated on a road surface or the like include a known snow removal machine disclosed, for example, in Japanese Patent Laid-Open Publication No. HEI-3-137311. The auger unit of this snow removal machine including the blower will be described with reference to FIG. 10.

In the auger unit 200 shown in FIG. 10, rotation of a drive shaft 201 causes an auger (not shown) to rotate and also causes a blower 202 to rotate as shown by arrow "a." Rotation of the auger causes snow to be collected to the center in the transverse direction. Advancement of the auger unit 200 causes the collected snow to be brought into a blower housing 203.

The snow brought into the blower housing 203 is thrown up by a plurality of throwing-up blades 204 of the blower 202 toward a chute 205 as shown by arrow "b." The chute 205 is provided on top of the blower housing 203. The snow is thrown through the chute 205 onto a desired location.

In the accumulated snow, a foreign matter 206 such as a stone can be buried. The foreign matter 206 can enter a gap 207 between the blower 202 and the blower housing 203.

When the foreign matter 206 enters the gap 207, the blower 202 presses the foreign matter 206 against the blower housing 203, increasing the frequency of catching the foreign matter 206 in the gap 207. When the foreign matter 206 is caught in the gap 207, it is necessary to remove the foreign matter 206 from the gap 207, becoming a burden on an operator.

While the foreign matter 206 is removed from the gap 207, the auger unit 200 should be stopped. Nonoperating time of the auger unit 200 becomes longer, which prevents an increase in workability.

When the foreign matter 206 is caught in the gap 207, a load greater than a predetermined value is applied to the blower 202 and the blower housing 203, deforming the blower 202 and the blower housing 203.

It is thus desirable to avoid catching a foreign matter in a gap between a blower and a blower housing.

In order to throw up snow within the blower housing 203 toward the chute 205 as shown by arrow "b," it is necessary to carry the snow on the throwing-up blades 204. When a large amount of snow enters the blower housing 203, some snow is left on supporting members supporting the throwing-up blades 204. Specifically, the supporting members are located in the vicinities of the center of the blower 202, thus having a throwing-up force smaller than that of the throwing-up blades 204. Snow carried on the supporting members thus remains on the supporting members without being thrown up.

The remaining snow on the supporting members adds its weight to the blower, preventing the blower from providing a sufficient torque to efficiently throw up snow to the chute. Further, for an extra load to the blower, it is required to increase the strength of the blower to withstand the load, which is unfavorable for reducing the weight of the blower.

Similarly, the output of the engine should be set larger than necessary in view of the application of an excessive load to the blower, which is unfavorable for reducing the size of the engine.

It is thus desired to prevent snow from remaining on the supporting members of the blower.

SUMMARY OF THE INVENTION

According to the present invention, there is provided a snow removal machine, which comprises: an auger for collecting snow; a blower provided in a blower housing for throwing up the collected snow; a drive shaft for rotating the auger and the blower; and a chute for guiding the thrown-up snow for throwing the snow onto a desired location; the blower comprising: a plurality of supporting members provided radially on the drive shaft; and a plurality of elastically deformable throwing-up blades attached to the respective supporting members; wherein, a vacant space is formed between the supporting -members and the throwing-up blades so as to allow elastic deformation of the throwing-up blades in a direction opposite to a direction of rotation.

According to the present invention, when a foreign matter enters a gap between the blower housing and one of the throwing-up blades, applying a load to the throwing-up blade, the throwing-up blade is elastically deformed toward the vacant space as described above, enlarging the gap between the blower housing and the throwing-up blade. The foreign matter entering the gap between the blower housing and the throwing-up blade is released from the gap, thereby to avoid catching the foreign matter in the gap.

Upon the release of the foreign matter form the gap, the load applied to the throwing-up blade by the foreign matter is eliminated, and the throwing-up blade returns to the original position by its elastic force. The blower thus rotates normally, continuing snow removing operation.

In this manner, the present invention avoids catching a foreign matter in the gap between the blower and the blower housing, preventing the occurrence of deformation and breakage of the blower, and thereby improving the durability of the blower.

The throwing-up blades are preferably detachably attached to the respective supporting members. In the following embodiments, each throwing-up blade is attached to the supporting member with bolts and nuts. When the throwing-up blade is plastically deformed or broken, it can be easily replaced with a new one without trouble only by unfastening the bolts.

A distal end portion of each supporting member is preferably formed in a downward slope from a rear side edge to a front side edge or vice versa so that a portion near a front side edge or a rear side edge of the throwing-up blade is elastically deformable in a direction opposite to a direction of rotation of the blower. When a foreign matter enters the gap between the blower housing and one of the throwing-up blades, applying a load to the throwing-up blade, a portion near one of the front and rear side edges of the throwing-up blade is elastically deformed rearward with respect to the rotation direction. The throwing-up blade is elastically deformed in a twisted state, enlarging the gap between the blower housing and the throwing-up blade. Under this, the foreign matter entering the gap between the blower housing and the throwing-up blade is released from the gap, thereby to avoid catching the foreign matter in the gap.

Each supporting member in the present invention preferably has an opening for allowing snow left on the supporting member to fall therethrough after the throwing-up blade throws up snow. Snow left on the supporting members is let fall through the openings to prevent remaining of snow on the supporting members, thereby to avoid a power loss of an engine due to the weight of snow left on the supporting members. The prevention of remaining snow on the supporting members eliminates the need for increasing the strength of the blower more than necessary.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
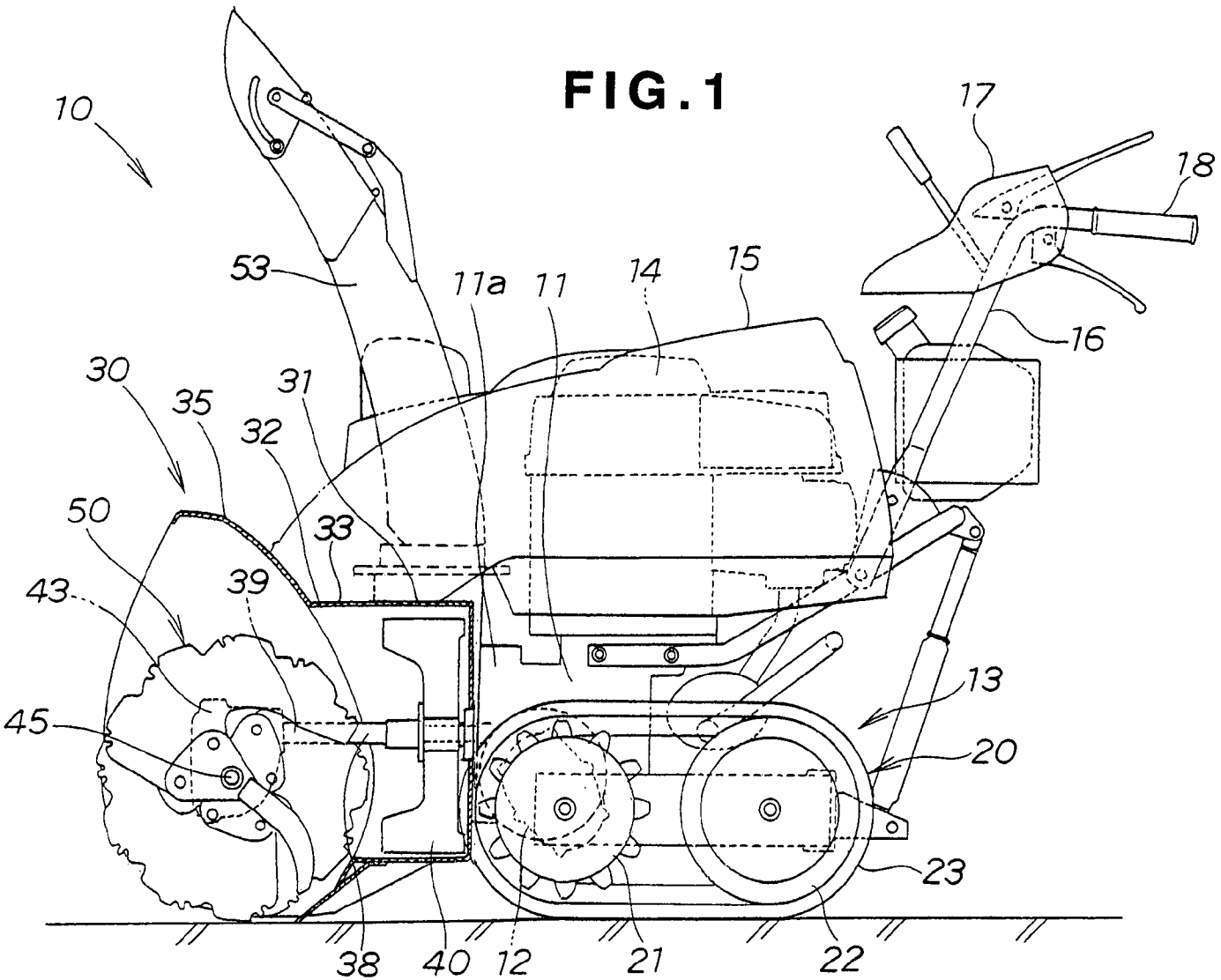
FIG. 1 is a side view of a snow removal machine according to a first embodiment of the present invention.

A snow removal machine 10 according to the present invention shown in FIG. 1 is a self-propelled walk-behind working machine which is led by an operator holding grips 18 (only the left grip 18 shown) of left and right operating handles 16 (only the left operating handle 16 shown), walking behind an operating panel 17. The snow removal machine 10 includes a body 11 comprised of a transmission case.

Drive electric motors 12 (only the left electric motor shown) are mounted to left and right lower portions of the body 11. A running section 13 is connected to the left and right electric motors 12. An engine 14 is mounted on top of the body 11. An auger unit 30 driven by the engine 14 is mounted to the front of the body 11. The rear of the auger unit 30 and the engine 14 are covered by a cover 15. The left and right operating handles 16 are extended from upper portions of the body 11 in a rearward and upward direction. The operating panel 17 is mounted between the left and right operating handles 16.

The running section 13 includes a left running unit 20 provided outside the left electric motor 12 and a right running unit (not shown) provided outside the right electric motor (not shown). The right running unit is configured the same as the left running unit 20 and will not be described.

The left running unit 20 has a left drive wheel 21 connected to the left electric motor 12, a left idler wheel 22 provided rotatably behind the drive wheel 21, and a left crawler belt 23 running between the left drive wheel 21 and the left idler wheel 22. The left crawler belt 23 is rotated by driving the left drive wheel 21 with the left electric motor 12.

The snow removal machine 10 is propelled by rotating the left and right crawler belts 23 of the running section 13 with the left and right electric motors 12, with the auger unit 30 driven by the engine 14 for performing snow removing operation.

The auger unit 30 will be described in detail below.

The auger unit 30 includes a blower housing 31 provided to a front portion 1l*a* of the body 11.

An auger housing 35 is provided to a front portion 32 of the blower housing 31. A drive shaft 38 extends forward from the engine 14. The drive shaft 38 extends through the blower housing 31 into the auger housing 35. A blower 40 disposed in the blower housing 31 is mounted on a middle portion of the drive shaft 38. A distal end portion 39 of the drive shaft 38 is connected to a power transmission member 43 (so-called auger mission) disposed centrally in the transverse direction. Left and right auger shafts 45 (right auger shaft not shown) extend left and right from the power transmission member 43. Left and right augers 50 (right auger not shown) are mounted on the left and right auger shafts 45.

When the drive shaft 38 is rotated by the driving of the engine 14, the blower 40 is rotated via the drive shaft 38, and the left and right auger shafts 45 are rotated via the power transmission member 43. The left and right augers 50 are rotated by the rotation of the left and right auger shafts 45.

When the snow removal machine 10 moves forward under this state, the left and right augers 50 cut into accumulated snow, breaking the snow. The broken snow is collected with the left and right augers 50 into the blower housing 31 located centrally in the transverse direction.

The snow collected in the blower housing 31 is thrown up by the blower 40 and thrown through a chute 53 provided on an upper portion 33 of the blower housing 31 onto a desired location.

Figure 2:
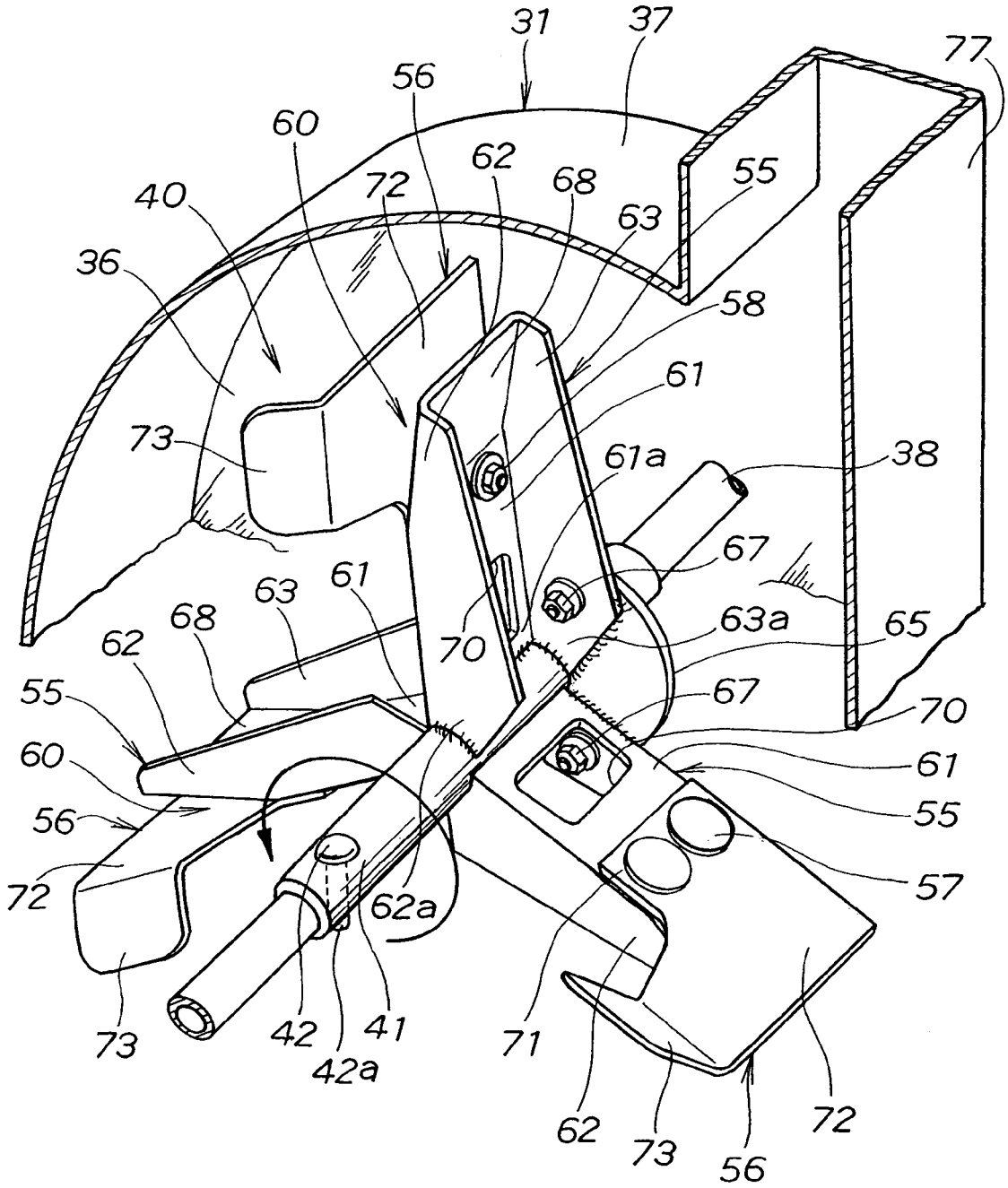
FIG. 2 is a perspective view of a blower according to the first embodiment shown in FIG. 1.

FIG. 2 illustrates in a perspective view the blower 40 as a component of the auger unit 30 according to the first embodiment of the present invention.

The blower 40 includes a tube 41 longitudinally fitted onto the drive shaft 38. The tube 41 is coupled to the drive shaft 38 by a coupling pin 42 inserted therethrough. A cotter pin (not shown) for preventing dislocation is inserted into a lower end portion 42*a* of the coupling pin 42 penetrating through the tube 41 and the drive shaft 38 and protruding from the tube 41, for preventing dislocation of the coupling pin 42. On the tube 41, a plurality of supporting members 55 (three in the embodiment shown in the figure) are radially provided at 120° intervals. Each of the supporting members 55 has an elastically deformable throwing-up blade 56 detachably attached thereto with bolts 57, 57 and nuts 58, 58 (see also FIG. 4). A vacant space 60 is formed between the throwing-up blade 56 and the supporting member 55 to allow the throwing-up blade 56 to be elastically deformed in a direction opposite to the direction of rotation of the throwing-up blade 56. That is, the throwing-up blade 56 is elastically deformable toward the vacant space 60.

The blower 40 is disposed in the blower housing 31 and rotated in the blower housing 31.

Each supporting member 55 is formed in a substantially U-shaped section shape with a supporting portion 61 to which the throwing-up blade 56 is attached and front and rear bent portions 62, 63 provided at the front and rear edges of the supporting portion 61.

Each supporting member 55 is mounted longitudinally along the drive shaft 38 via the tube 41. Specifically, with a proximal end portion 61*a* of the supporting portion 61 longitudinally abutted on the tube 41, with proximal ends 62*a*, 63*a* of the front and rear bent portions 62, 63 formed in an arc shape abutted on the periphery of the tube 41, and with the rear bent portion 63 abutted on a flange 65, the rear bent portion 63 is fastened to the flange 65 with a bolt 66 (see FIG. 4) and a nut 67. The flange 65 is secured to the tube 41. The proximal end portion 61*a* of the supporting portion 61 is welded to the tube 41. The proximal ends 62*a*, 63*a* of the front and rear bent portions 62, 63 are welded to the tube 41. A portion near the proximal end 63*a* of the rear bent portion 63 is welded to the flange 65.

The supporting portion 61 of each supporting member 55 has a tapered portion 68 formed at a flat distal end portion thereof. The tapered portion 68 is inclined rearward with respect to the rotation direction of the blower 40 as shown by an arrow. The throwing-up blade 56 is removably mounted in the vicinity of the proximal end of the tapered portion 68 with the bolts 57, 57 and the nuts 58, 58.

The supporting portion 61 has a rectangular opening 70 formed in the vicinity of its proximal end portion 61*a*. When the blower 40 throws up snow toward the chute 53, snow left on the supporting member 55 escapes through the rectangular opening 70. The rectangular opening 70 is formed as large as possible with a sufficient rigidity of the supporting member 55 ensured, without reducing the amount of snow thrown by the throwing-up blade 56.

The throwing-up blade 56 has a blade body 72, a front bent portion 73 formed at the blade body 72, and a proximal end portion 71. The proximal end portion 71 of the throwing-up blade 56 is detachably mounted in the vicinity of the tapered portion 68 of the supporting member 55 with the bolts 57, 57 and the nuts 58, 58. The blade body 72 extends radially outward from the proximal end portion 71. The front bent portion 73 of the blade body 72 is inclined in the rotation direction of the blower 40.

Since the throwing-up blade 56 is thus detachably attached to the supporting member 55, the throwing-up blade 56, when plastically deformed or broken, can be easily replaced with a new throwing-up blade 56 without trouble only by disengaging the bolts 57, 57 and the nuts 58, 58.

Figure 3:
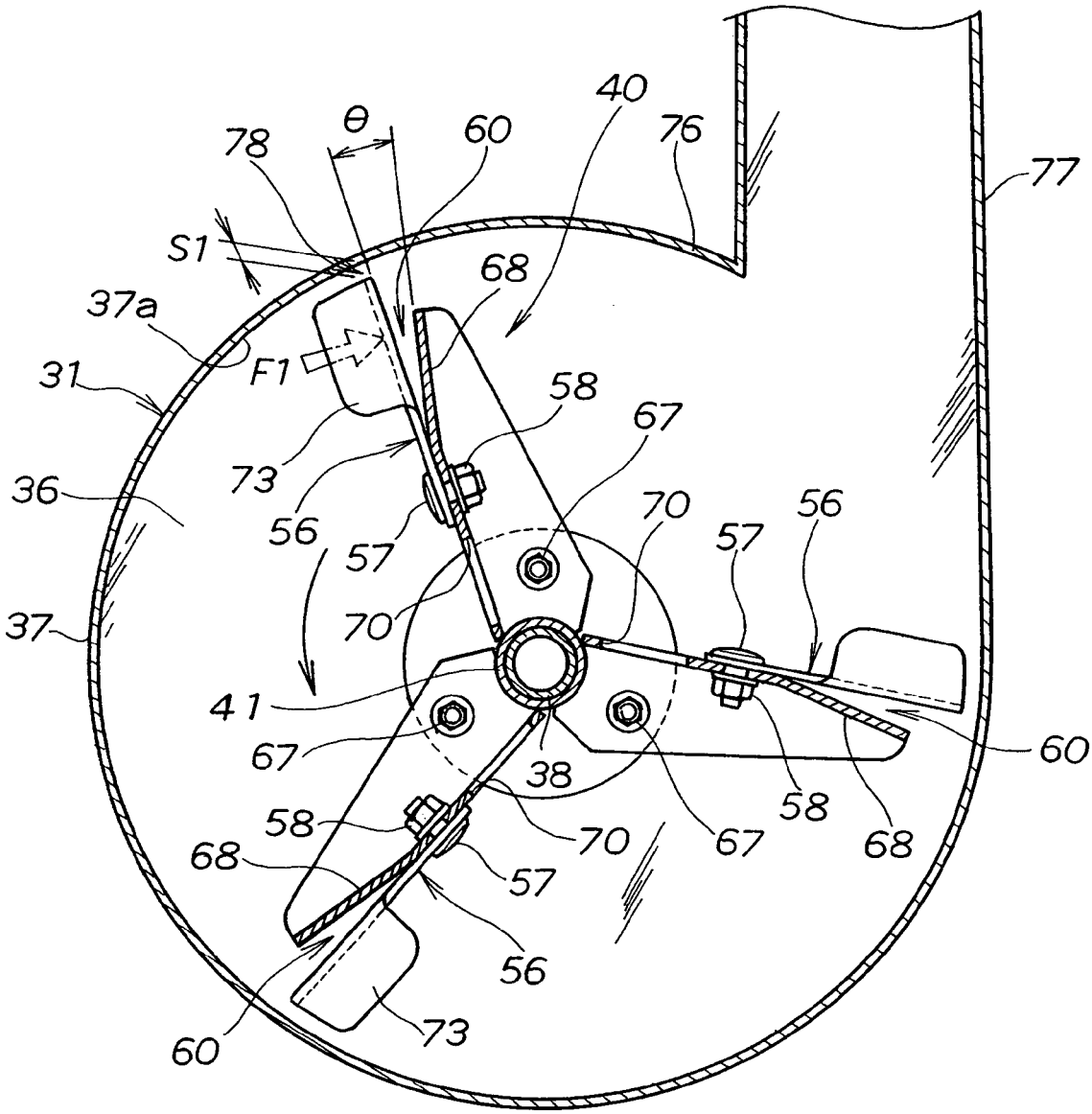
FIG. 3 is a front view of the blower shown in FIG. 2.

As shown in FIG. 3, the blower housing 31 has a rear wall 36 formed in a disc shape, a cylindrical peripheral wall 37 formed at the periphery of the rear wall 36, and a tubular portion 77 formed at a left upper portion 76 of the peripheral wall 37. The chute 53 shown in FIG. 1 is mounted on the tubular portion 77.

The blower 40 is disposed in the blower housing 31, forming a gap 78 of a fixed clearance S1 between the throwing-up blades 56 of the blower 40 and an inside peripheral surface 37*a* of the blower housing 31.

As described above, each supporting member 55 has at the distal end of the supporting portion 61 the tapered portion 68 inclined in a direction (rearward) opposite to the direction of rotation of the blower 40. The tapered portion 68 is thus distanced rearward from the throwing-up blade 56 by vacant space angle θ.

The vacant space angle θ is set such that the throwing-up blade 56 does not exceed the range of elastic deformation when deformed rearward and abutting on the tapered portion 68.

More specifically, when the blower 40 rotates in the direction of an arrow and load F1 is applied to the throwing-up blade 56 as shown by an arrow, the throwing-up blade 56 is elastically deformed rearward, abutting on the tapered portion 68. When the load F1 is eliminated from the throwing-up blade 56, the throwing-up blade 56 is returned to the original position (the state shown in the figure) by its elastic force.

The throwing-up blades 56 are preferably molded from SK material (carbon tool steels) or S50C material (carbon steels), for example, as members with a high elastic limit. The material of the throwing-up blades 56, however, is not limited to SK material and S50C material.

Figure 4:
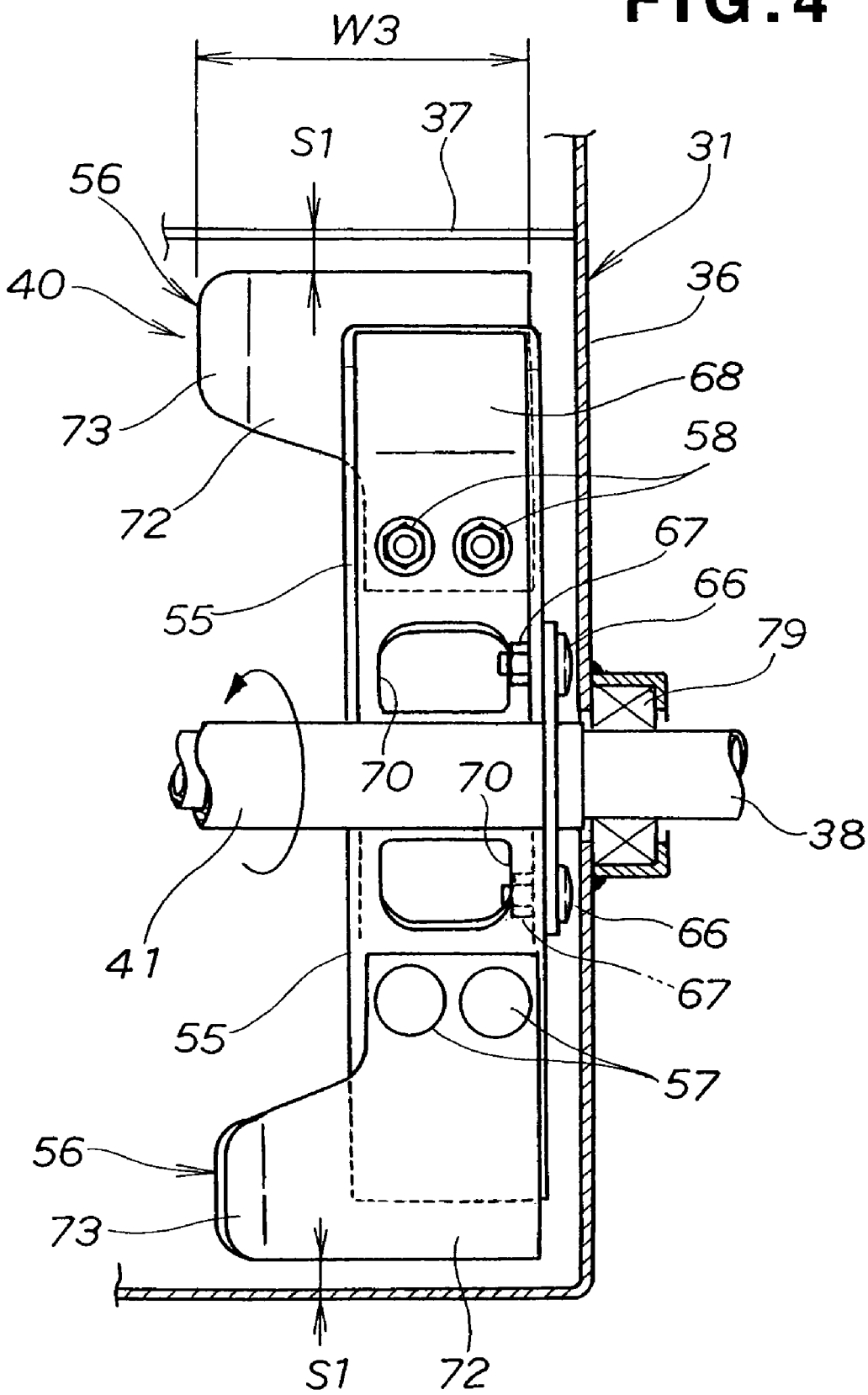
FIG. 4 is a cross-sectional view of the blower shown in FIG. 2.

The drive shaft 38 extends forward from the engine 14 as shown in FIG. 1. The drive shaft 38 passes through the blower housing 31 and is rotatably fitted into a bearing 79 of the blower housing 31 as shown in FIG. 4. The blower 40 disposed in the blower housing 31 is mounted on a middle portion of the drive shaft 38. The drive shaft 38 is rotated by the engine 14, thereby to rotate the blower 40 via the drive shaft 38 as shown by an arrow.

The blade bodies 72 of the throwing-up blades 56 protrude radially outward from the supporting members 55 and also extend forward. The front bent portions 73 extending forward are inclined in the rotation direction of the blower 40.

The blade bodies 72 have a large width W3, thereby to be able to carry a relatively large amount of snow on the throwing-up blades 56. The throwing-up blades 56 can therefore efficiently convey snow to the chute 53.

Now, the operation of the blower 40 according to the first embodiment will be described with reference to FIGS. 5A to 5H.

First, description will be made of an example in which a foreign matter 80 enters the gap 78 between the blower 40 and the inside peripheral surface 37*a* of the blower housing 31, with reference to FIGS. 5A to 5D.

Figure 5A:
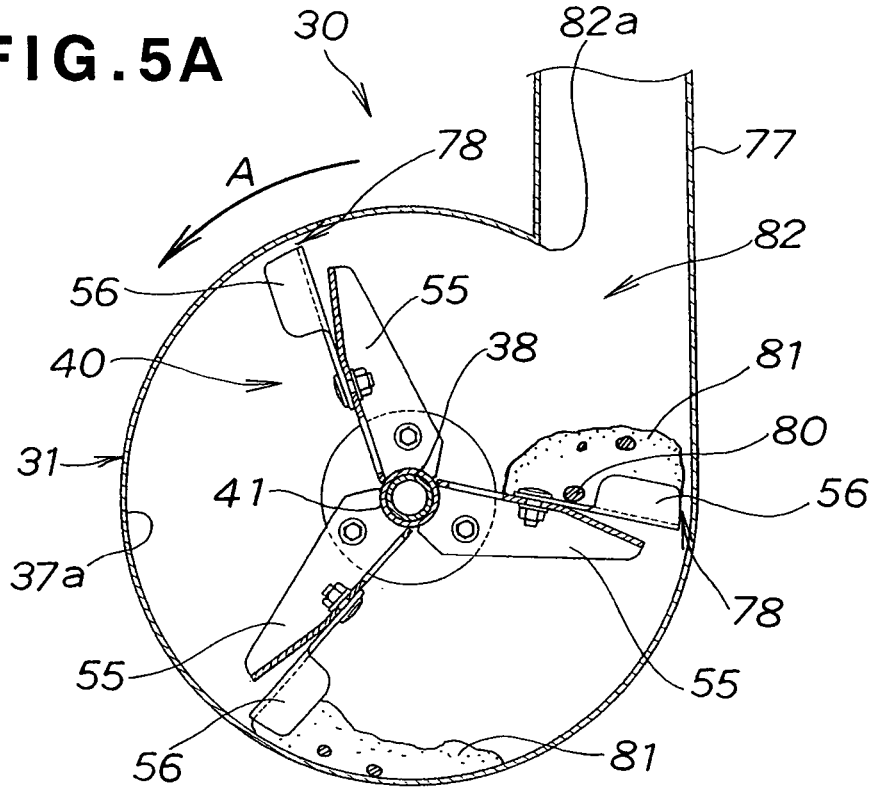
FIGS. 5A to 5H are diagrams illustrating the movement of the blower according to the first embodiment of the present invention.

Referring to FIG. 5A, the drive shaft 38 is rotated by the engine 14 (see FIG. 1), thereby to rotate via the drive shaft 38 the left and right augers 50 (see FIG. 1) and the blower 40 in the direction of arrow A.

The left and right augers 50 rotate, collecting snow 81 to the center in the transverse direction. The snow removal machine 10 (see FIG. 1) is moved forward, thereby to bring the collected snow 81 into the blower housing 31. The snow 81 brought into the blower housing 31 is picked up by the throwing-up blade 56 of the blower 40. The picked-up snow 81 is carried on the throwing-up blade 56.

Then, the throwing-up blade 56 carrying the snow 81 is moved below an opening 82 of the blower housing 31.

Figure 5B:
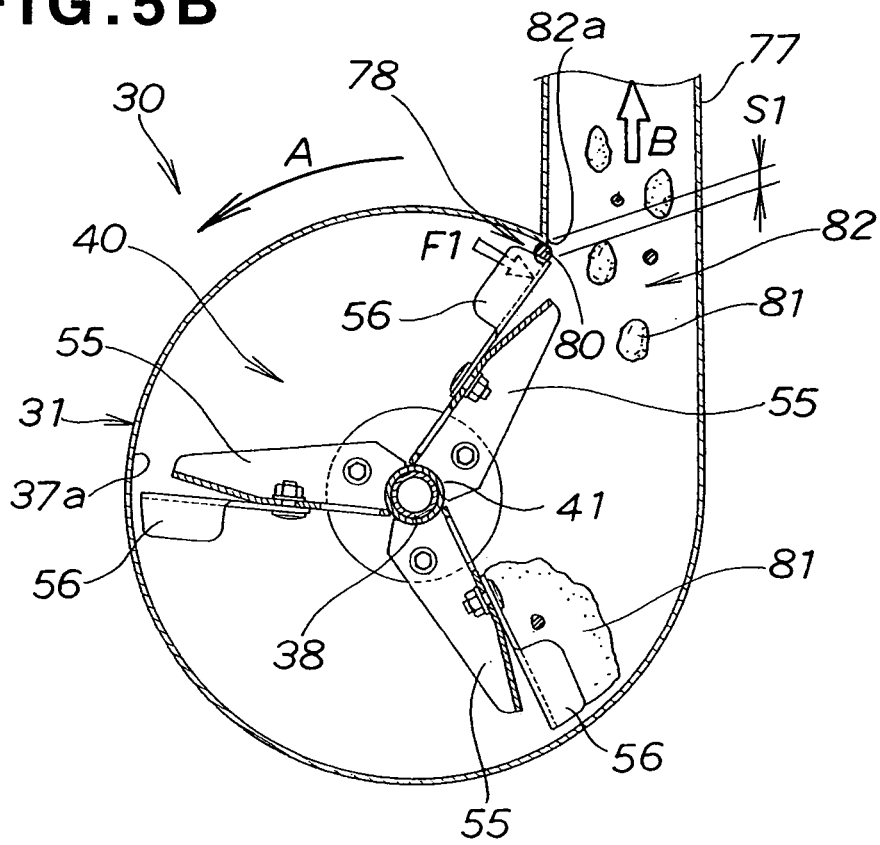

Referring to FIG. 5B, from below the opening 82 of the blower housing 31, the throwing-up blade 56 carrying the snow 81 passes the opening 82, throwing up the snow 81 carried on the throwing-up blade 56 toward the opening 82 by centrifugal force, and introducing it through the tubular portion 77 into the chute 53 (see FIG. 1) as shown by arrow B. The snow 81 is guided by the chute 53 to be thrown onto a desired location.

In the snow 81, a foreign matter 80 such as a stone can be buried and the foreign matter 80 can enter the gap 78 between the blower 40 and the inside peripheral surface 37*a* of the blower housing 31, especially the gap 78 in the vicinity of the periphery 82*a* of the opening 82. If the entering foreign matter 80 is larger than the clearance S1 between the blower 40 and the inside peripheral surface 37*a*, load F1 is applied to the throwing-up blade 56 in a direction shown by an arrow.

Figure 5C:
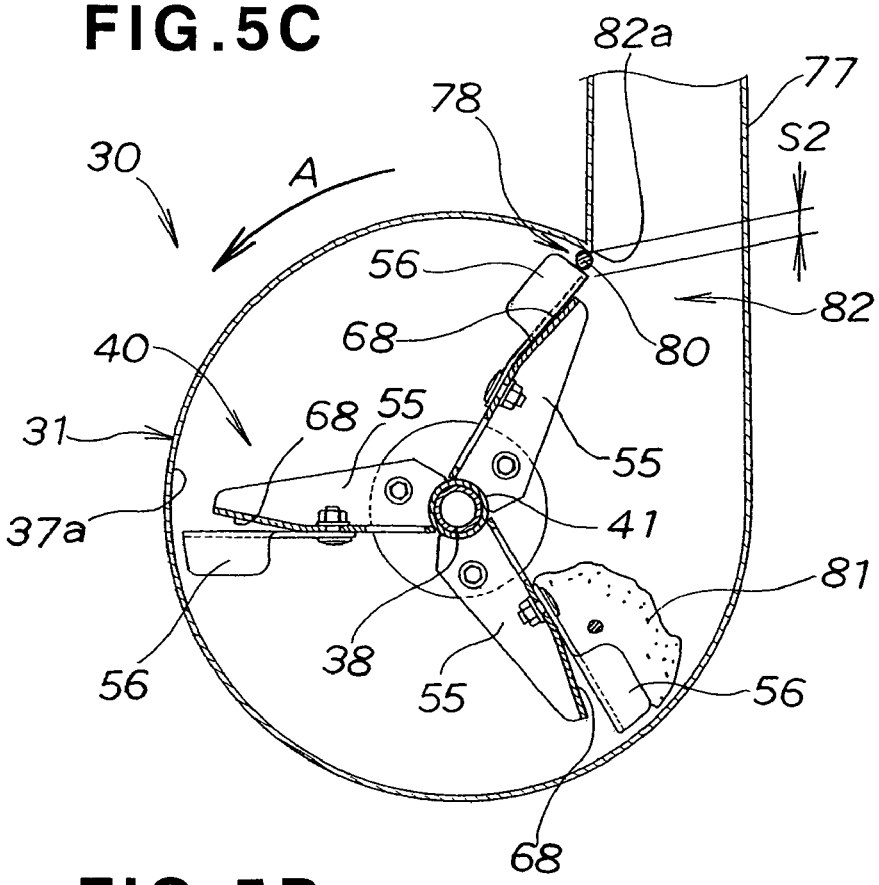

Referring to FIG. 5C, the throwing-up blade 56 is elastically deformed rearward, abutting on the tapered portion 68. More specifically, the throwing-up blade 56 elastically bends only about the proximal end portion thereof while the blade body 72 does not bend but rather pivots rearwardly, free from deformation, about the proximal end portion until the blade body contacts the flat distal end portion of the tapered portion 68. As a result, the clearance S1 between the blower 40 and the inside peripheral surface 37*a* (see FIG. 5B) is changed to a clearance S2 which is larger than the foreign matter 80.

Figure 5D:
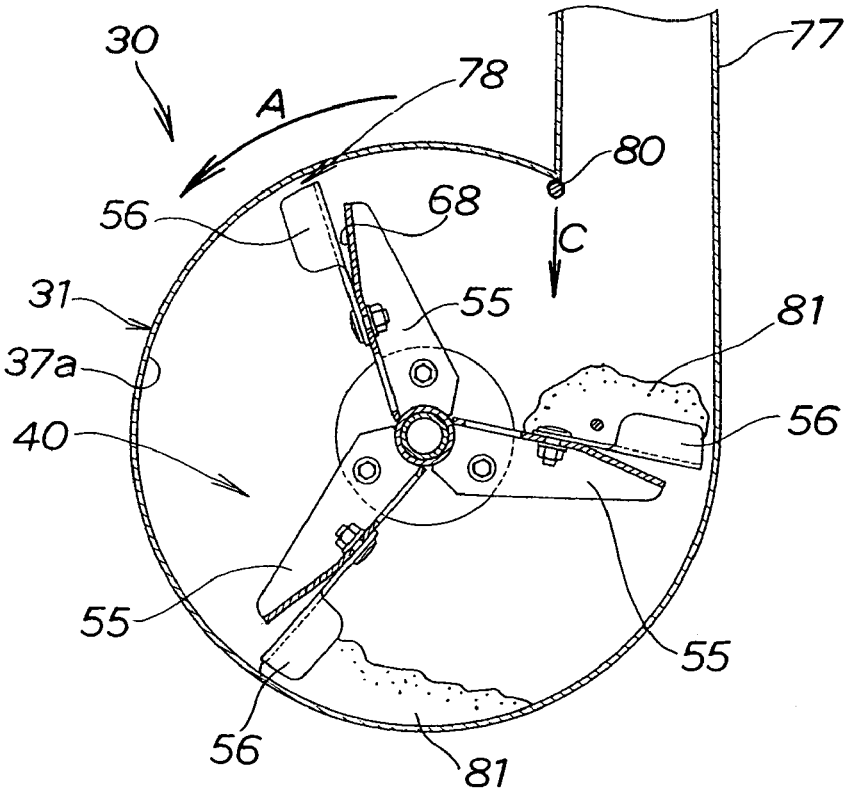

As shown in FIG. 5D, the foreign matter 80 is released from the gap 78 and falls. The blower 40 continuously rotates as shown by arrow A. Specifically, the foreign matter 80 entering the gap 78 between the blower 40 and the inside peripheral surface 37*a* escapes from the gap 78 and falls as shown by arrow C. In this manner, the foreign matter 80 is prevented from being caught in the gap 78 between the blower 40 and the inside peripheral surface 37*a*.

Upon the release of the foreign matter 80 from the gap 78, the load applied by the foreign matter 80 to the throwing-up blade 56 is eliminated, and the throwing-up blade 56 is returned to the original position by its elastic force. The blower 40 is thus allowed to rotate normally, continuing snow removing operation.

Now, an example of removing snow 81 from the supporting members 55 of the blower 40 will be described with reference to FIGS. 5E to 5H.

Figure 5E:
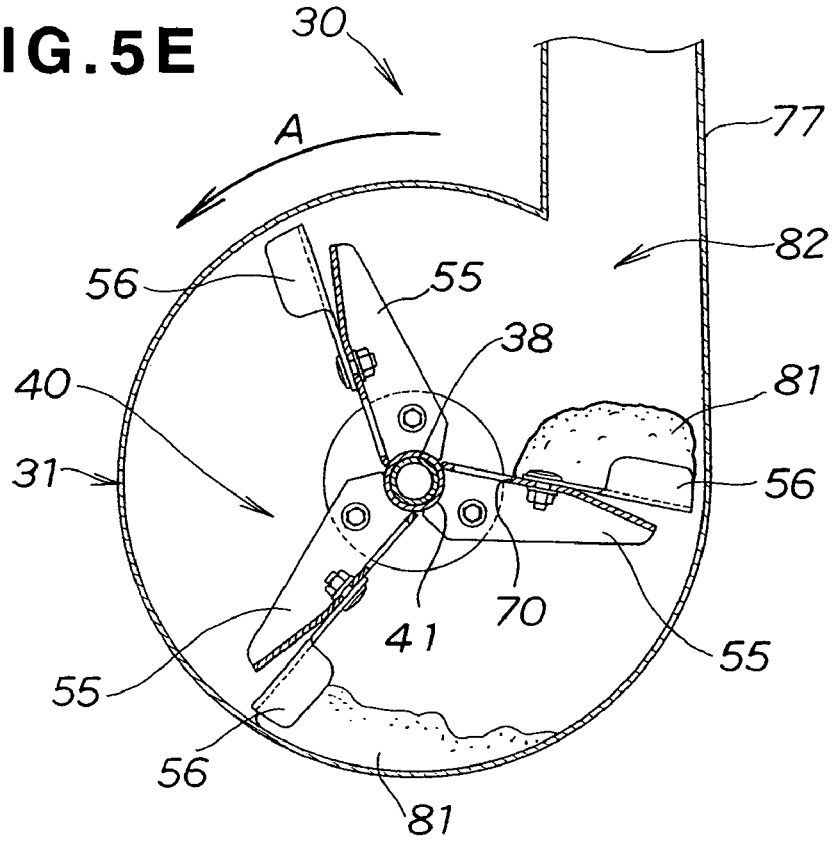

Referring to FIG. 5E, the drive shaft 38 is rotated by the engine 14 (see FIG. 1), thereby to rotate the left and right augers 50 (see FIG. 1) and the blower 40 as shown by arrow A via the drive shaft 38.

The left and right augers 50 rotate, collecting snow 81 to the center in the transverse direction. The snow removal machine 10 (see FIG. 1) is moved forward, thereby to bring the collected snow 81 into the blower housing 31. The snow 81 brought into the blower housing 31 is picked up by the throwing-up blade 56 of the blower 40 to carry the collected snow 81 on the throwing-up blade 56.

Thereafter, the throwing-up blade 56 carrying the snow 81 is moved below the opening 82 of the blower housing 31.

Figure 5F:
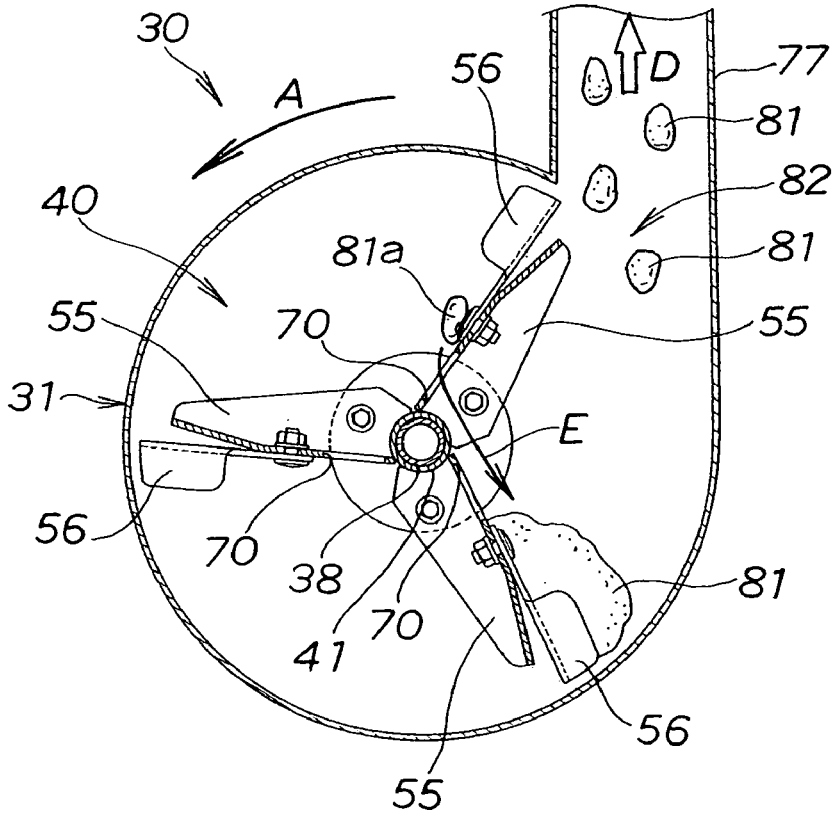

Referring to FIG. 5F, from below the opening 82 of the blower housing 31, the throwing-up blade 56 carrying the snow 81 passes the opening 82, throwing up the snow 81 on the throwing-up blade 56 toward the opening 82 by centrifugal force, and introducing it through the tubular portion 77 into the chute 53 (see FIG. 1) as shown by arrow D. The snow 81 is guided by the chute 53 to be thrown onto a desired location.

If a large amount of snow 81 is carried on the throwing-up blade 56, the snow 81 is put over the supporting member 55. The snow put over the supporting member 55 cannot be thrown up into the opening 82 by centrifugal force. The snow is left on the supporting member 55 and the weight of the snow left on the supporting member 55 is added to the weight of the blower 40. When the blower 40 with the added weight of the snow is rotated, a load is applied to the blower 40, resulting in an insufficient torque of the blower 40.

To solve this, the rectangular opening 70 is formed in the supporting member 55 for mounting the throwing-up blade 56 to the tube 41 so that, after the throwing-up blade 56 throws up the snow 81, snow 81*a* left on the supporting member 55 falls through the opening 70 as shown by arrow E. The snow 81*a* falling through the opening 70 hits the tube 41, for example, and moves onto snow 81 on the lower throwing-up blade 56.

Figure 5G:
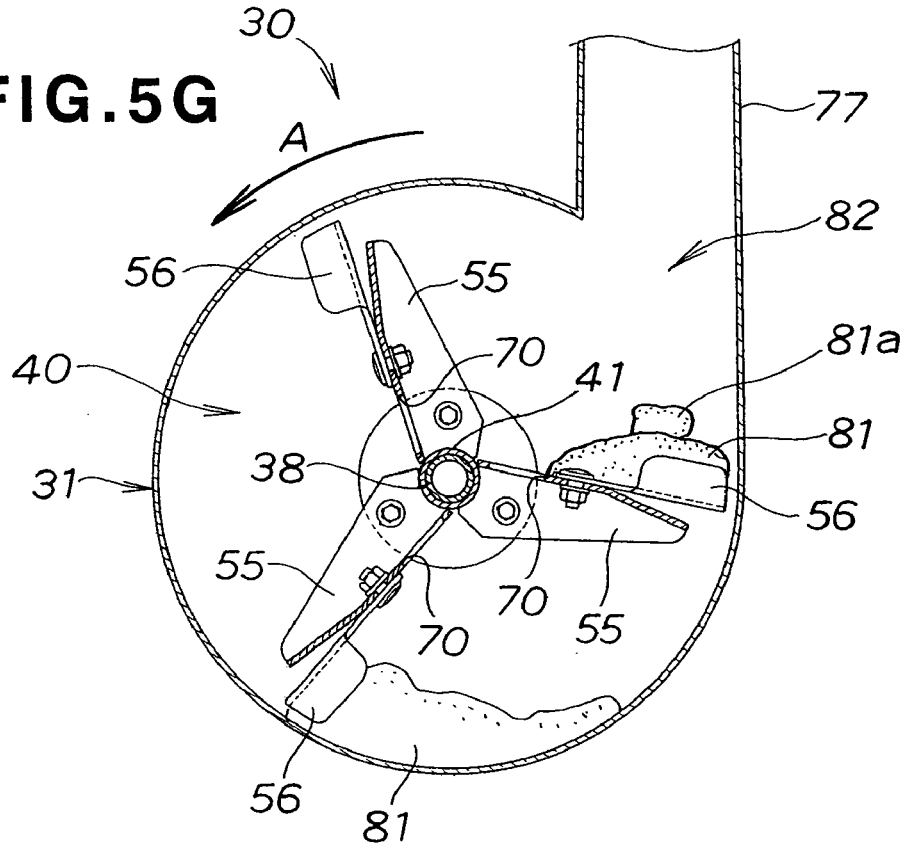

As shown in FIG. 5G, the throwing-up blade 56 carrying the falling snow 81*a* is moved below the opening 82 of the blower housing 31.

Figure 5H:
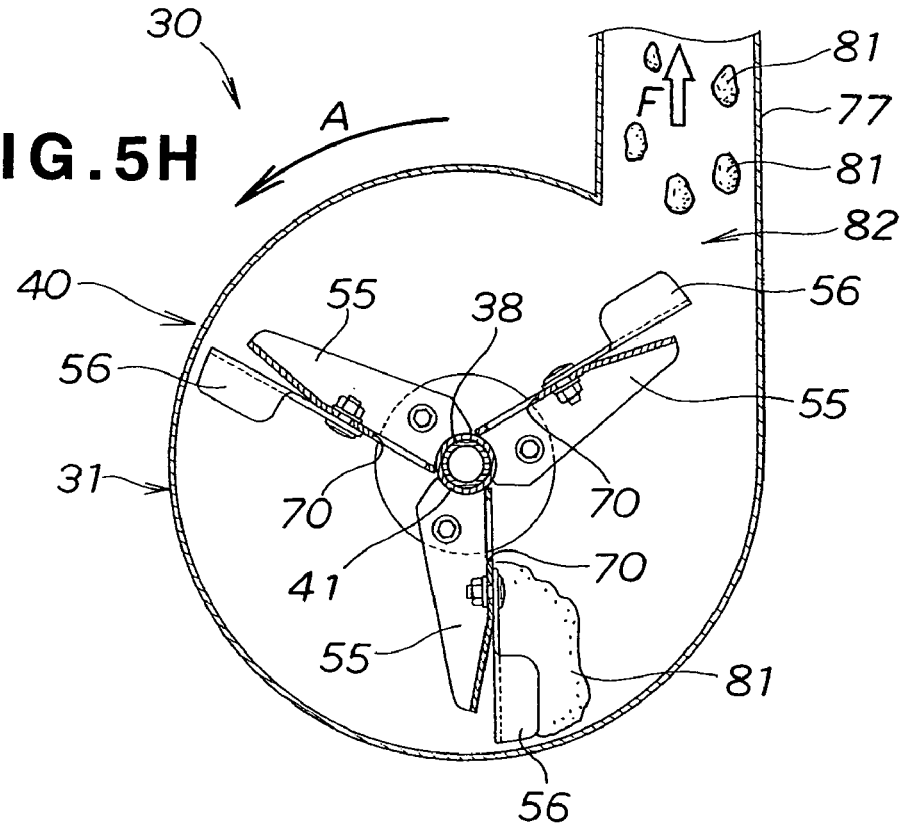

Referring to FIG. 5H, from below the opening 82 of the blower housing 31, the throwing-up blade 56 carrying the falling snow 81*a* passes the opening 82, throwing up the snow 81 and the falling snow 81*a* carried on the throwing-up blade 56 toward the opening 82 by centrifugal force.

The thrown up snow 81 and 81*a* is introduced through the tubular portion 77 into the chute 53 (see FIG. 1) as shown by arrow F and thrown onto a desired location.

As described above, the snow 81*a* left on the supporting member 55 falls through the opening 70 and is thrown up by the following throwing-up blade 56, so that no snow is left on the supporting member 55. This eliminates an additional load caused by the weight of the snow 81*a* left on the supporting members 55 to the blower 40, allowing the blower 40 to rotate at a desired rotation speed, efficiently throwing up the snow 81 to the chute 53 (see FIG. 1) by the throwing-up blades 56.

Since the snow 81*a* is prevented from being left on the supporting members 55, it becomes needless to increase the strength of the blower 40 more than required. The blower 40 can thus be reduced in weight. Also, it is not necessary to set the power of the engine 14 (see FIG. 1) larger, enabling a reduction in weight of the engine 14, and allowing reductions in size and weight of the snow removal machine 10 (see FIG. 1).

Now, a blower 90 according to a second embodiment will be described with reference to FIGS. 6 to 9. Components of the blower 90 according to the second embodiment identical to those in the first embodiment are given the same reference numerals and will not be described.

Figure 6:
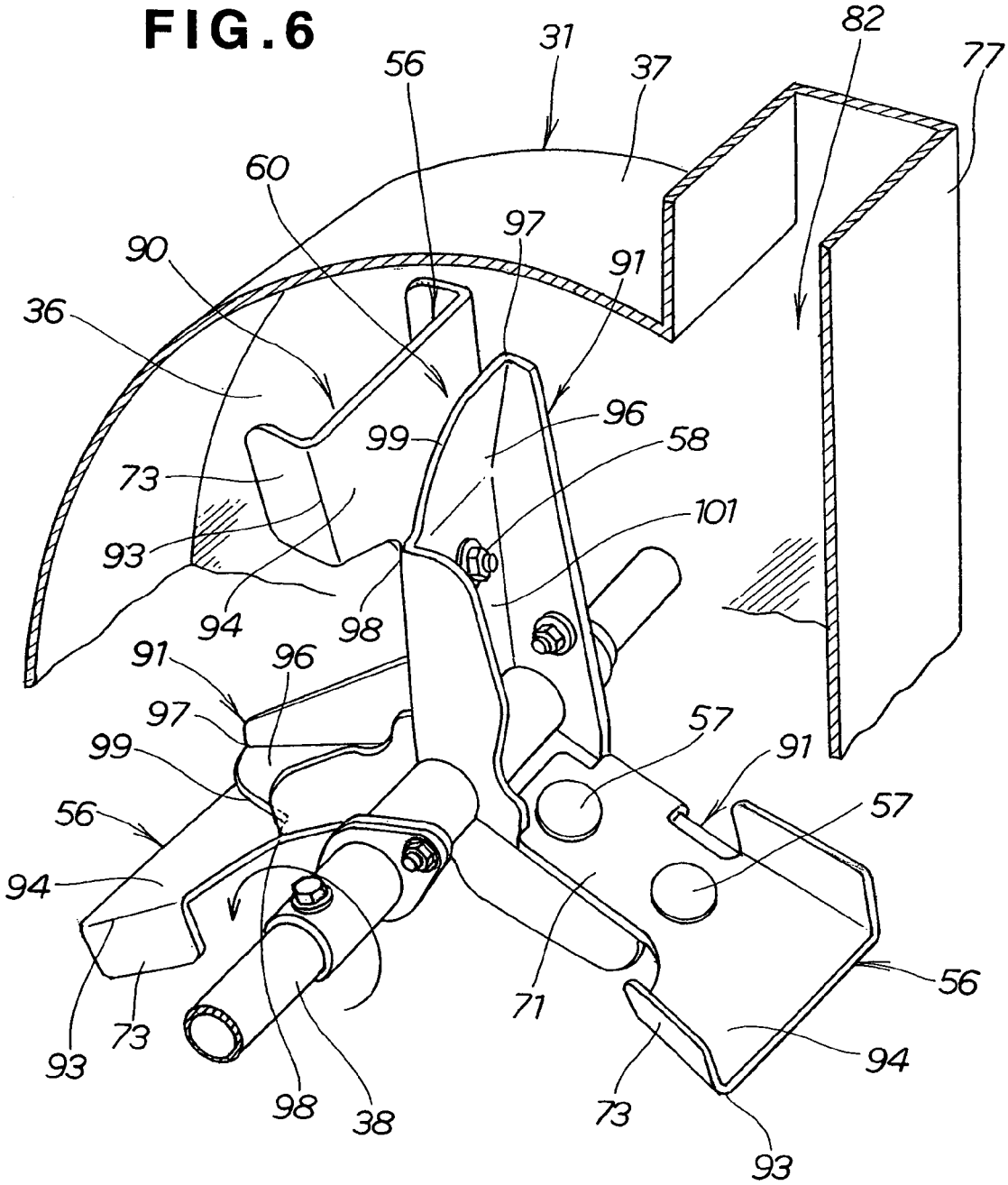
FIG. 6 is a perspective view of a blower for use in a snow removal machine according to a second embodiment of the present invention.

The blower 90 according to the second embodiment shown in FIG. 6 includes a plurality of supporting members 91 (three in the embodiment) radially mounted on a drive shaft 38 for rotating the blower 90. An elastically deformable throwing-up blade 56 is mounted to each of the supporting members 91. Like the supporting members 55 in the first embodiment, each supporting member 91 has a tapered portion 96 formed at a flat distal end portion of a supporting portion 101. The tapered portion 96 is inclined in a direction (rearward) opposite to the direction of rotation (arrow direction) of the blower 90. A vacant space 60 is thus formed between the throwing-up blade 56 and the 10 tapered portion 96. The vacant space 60 allows elastic deformation of the throwing-up blade 56 in a direction opposite to the rotation direction.

The tapered portion (distal end portion) 96 of the supporting member 91 is formed with an oblique edge 99 sloped downward from a rear side edge 97 to a front side edge 98 so that, when the throwing-up blade 56 is elastically deformed rearward with respect to the rotation direction, abutting on the tapered portion 96, a portion (portion near one of front and rear side edges) 94 near a front side edge (one of front and rear side edges) 93 of the throwing-up blade 56 can be further elastically deformed rearward with respect to the rotation direction. That is, for enabling elastic deformation of the portion 94 near the front side edge 93, the tapered portion (distal end portion) of the supporting member 91 is formed with the oblique edge 99 sloped downward from the rear side edge 97 to the front side edge 98. Thus a front portion of the distal end portion of the tapered portion 96 is obliquely cut off. The portion 94 near the front side edge 93 of the throwing-up blade 56 is further elastically deformable in a rearward direction. In other words, the throwing-up blade 56 is elastically deformable into a twisted state.

Figure 7:
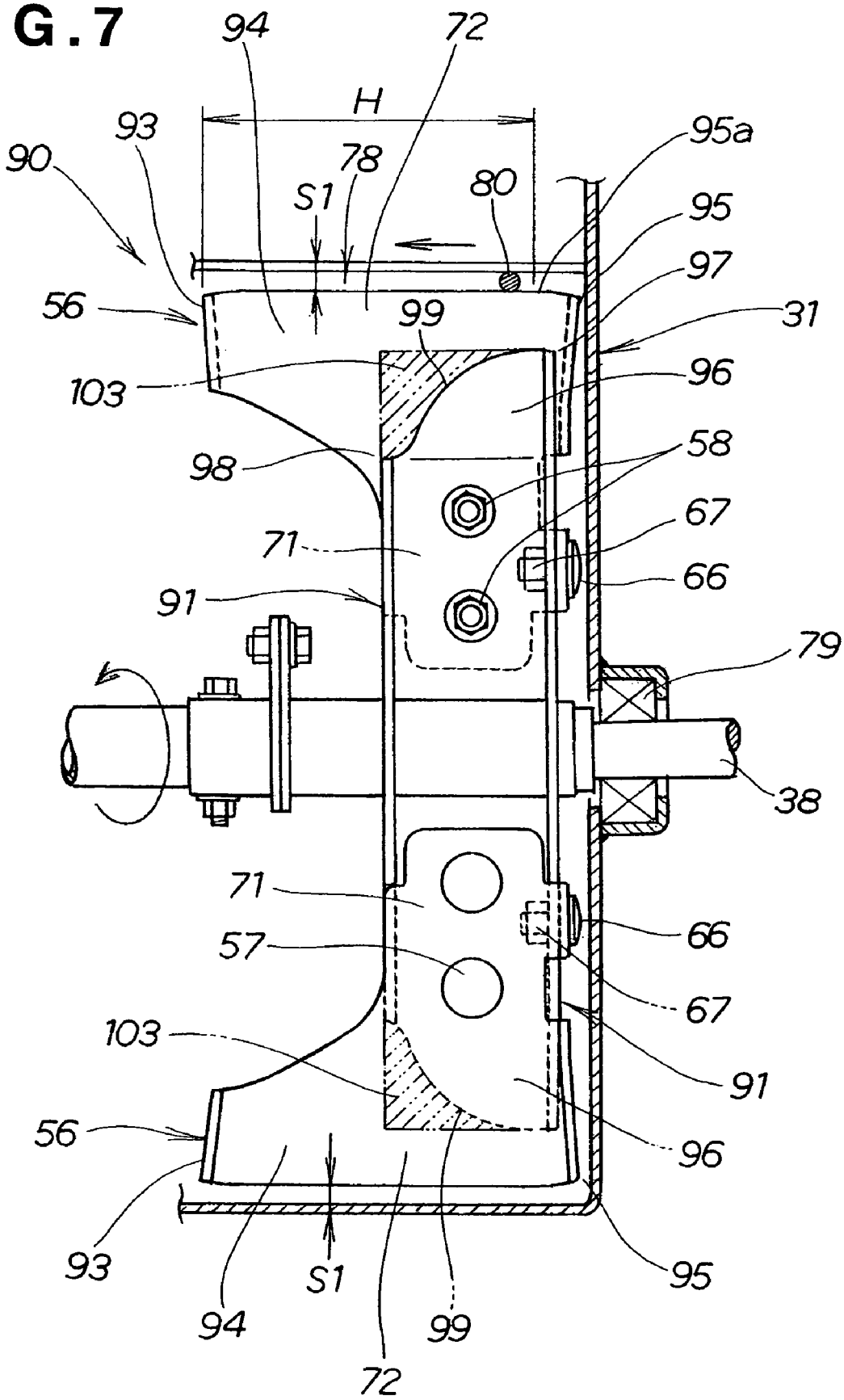
FIG. 7 is a cross-sectional view of the blower shown in FIG. 6.

As shown in FIG. 7, the tapered portion (distal end portion) 96 of the supporting member 91 is formed with the oblique edge 99 sloped downward from the rear side edge 97 to the front side edge 98 in a curved downward slope, for example. With this, the tapered portion (distal end portion)

96 of the supporting member 91 has a portion 103 shown by imaginary lines removed, as compared with the tapered portion 68 (see FIGS. 2 and 4) of the supporting member 55 in the first embodiment.

Now, the reason why the tapered portion (distal end portion) 96 of the supporting member 91 is formed with the oblique edge 99 sloped downward from the rear side edge 97 to the front side edge 98 will be described.

A blade body 72 constituting part of the throwing-up blade 56 is extended forward to protrude a front half of the throwing-up blade 56, that is, the portion 94 near the front side edge 93, forward from the tapered portion 96 of the supporting member 91, thereby to increase the area of the blade body 72 for throwing up a relatively large amount of snow.

Since the front half of the throwing-up blade 56 is extended forward from the tapered portion 96 of the supporting member 91, the front side edge 93 of the throwing-up blade 56 is not supported on the tapered portion 96 of the supporting member 91.

The tapered portion 96 of the supporting member 91 is formed with the oblique edge 99 sloped downward from the rear side edge 97 to the front side edge 98, thereby to support the rear side edge 95 of the throwing-up blade 56 on the tapered portion 96 of the supporting member 91.

Here, H is a range between a portion 95*a* in the vicinity of the rear side edge 95 of the throwing-up blade 56 and the front side edge 93 of the throwing-up blade 56.

When a foreign matter 80 enters a gap 78 between the blower housing 31 and the throwing-up blade 56, applying a load to the throwing-up blade 56, a portion within the range H of the throwing-up blade 56 is elastically deformed, enlarging the gap 78 between the blower housing 31 and the throwing-up blade 56.

The amount of elastic deformation of the throwing-up blade 56 becomes larger toward the front side edge 93 of the throwing-up blade 56. If the foreign matter 80 entering the gap 78 is relatively large, the foreign matter 80 is moved in a direction of a larger amount of elastic deformation as shown by an arrow to be released through the gap 78 opened widely.

Now, the operation of the blower 90 according to the second embodiment will be described with reference to FIGS. 8A to 8E.

Figure 8A:
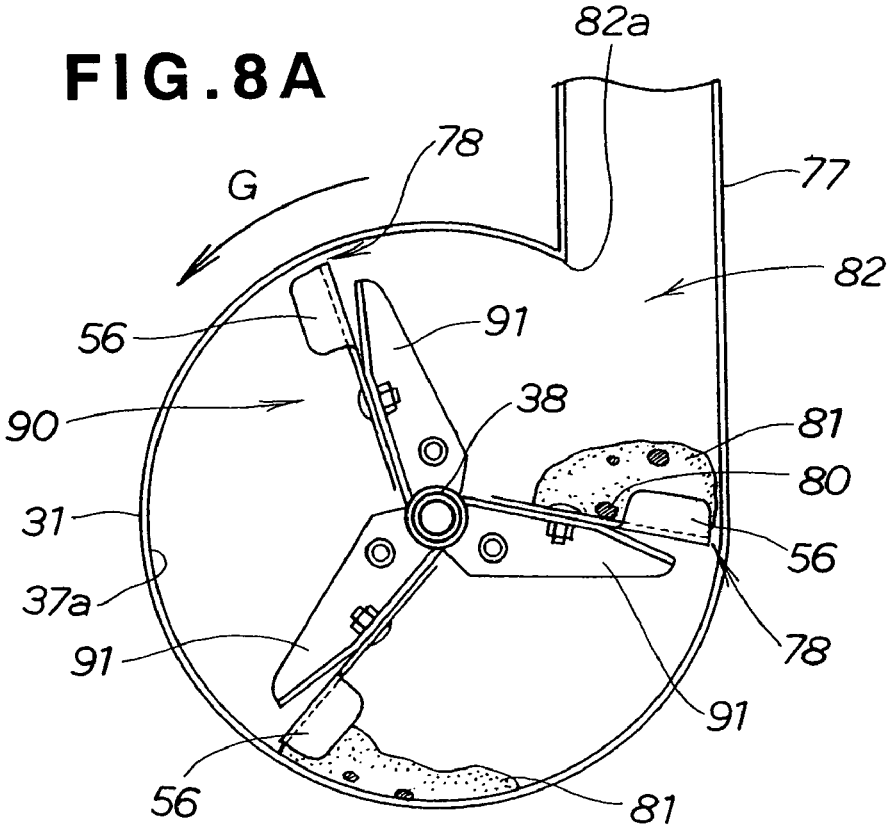
FIGS. 8A to 8E are diagrams illustrating the movement of the blower according to the second embodiment.

Referring to FIG. 8A, the drive shaft 38 is rotated by the engine 14 (see FIG. 1) to rotate left and right augers 50 (see FIG. 1) and the blower 90 as shown by arrow G via the drive shaft 38.

The left and right augers 50 are rotated to collect snow 81 to the center in the transverse direction. The snow removal machine 10 (see FIG. 1) is moved forward to bring the collected snow 81 into the blower housing 31.

The snow 81 brought into the blower housing 31 is picked up by each of the throwing-up blades 56 of the blower 90. The picked-up snow 81 is carried on the throwing-up blade 56. The throwing-up blade 56 carrying the snow 81 is then moved to a position below an opening 82 of the blower housing 31.

Figure 8B:
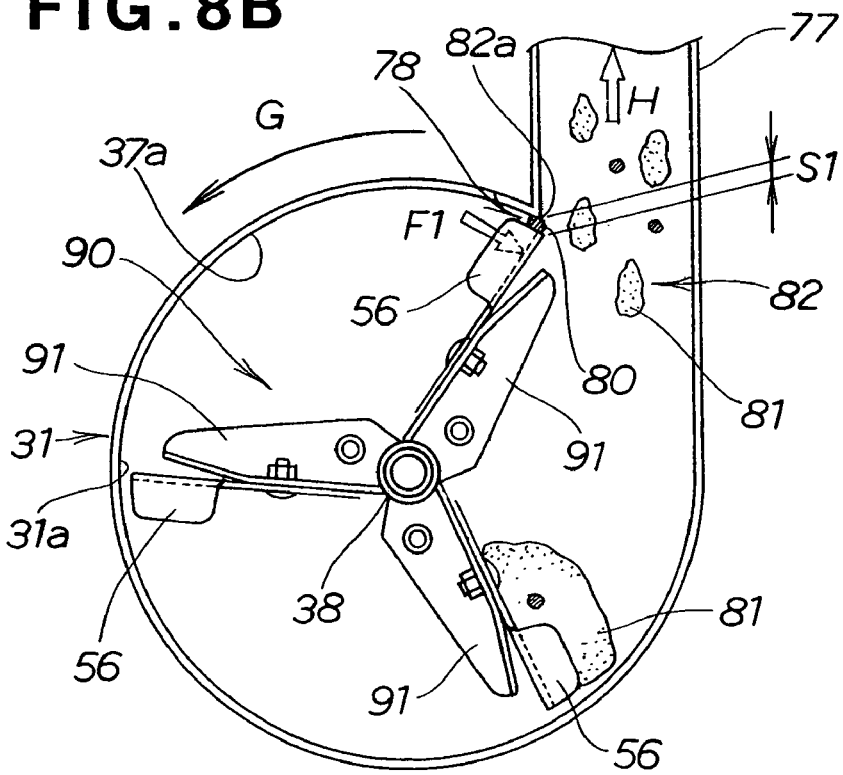

Referring to FIG. 8B, when passing from the position below the opening 82 of the blower housing 31 through the opening 82, the throwing-up blade 56 carrying the snow 81 throws up the snow 81 to the opening 82 by centrifugal force, introducing it through a tubular portion 77 into a chute 53 (see FIG. 1) as shown by arrow H. The snow 81 is guided by the chute 53 and thrown onto a desired location.

At that time, a foreign matter 80 such as a stone can be buried in the snow 81. The foreign matter 80 can enter the gap 78 between the blower 40 and an inside peripheral surface 37*a* of the blower housing 31, especially the gap 78 in the vicinity of the peripheral edge 82*a* of the opening 82.

If the entering foreign matter 80 is larger than a clearance S1 between the blower 40 and the inside peripheral surface 37*a*, load F1 is applied to the throwing-up blade 56 as shown by an arrow.

Figure 8C:
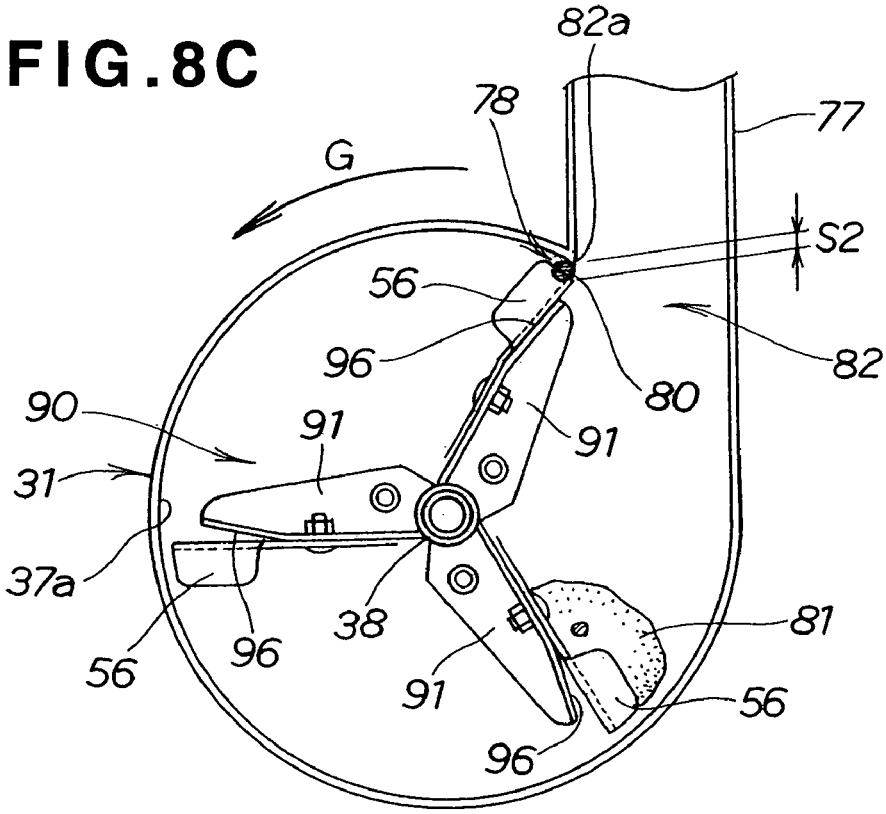

As shown in FIG. 8C, the throwing-up blade 56 is elastically deformed in a rearward direction opposite to the rotation direction of the blower 90, abutting on the tapered portion 96. The clearance S1 between the blower 90 and the inside peripheral surface 37*a* (see FIG. 8B) is changed to a clearance S2 larger than the foreign matter 80.

Figure 8D:
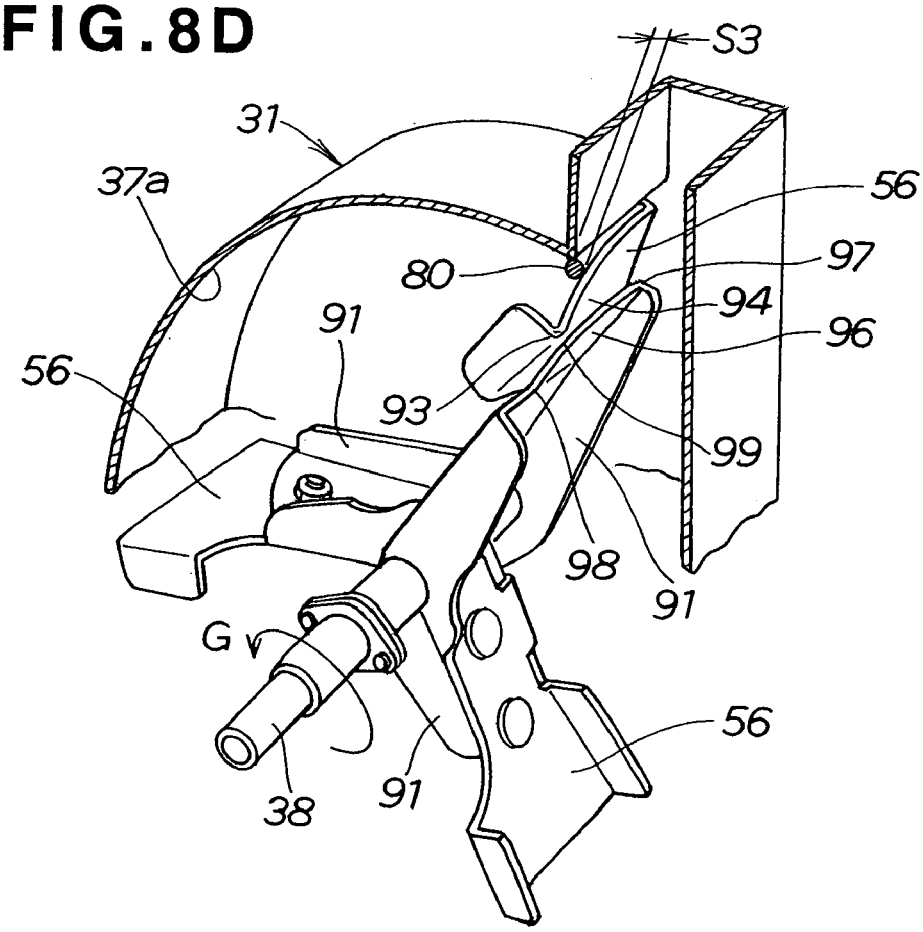

Referring to FIG. 8D, when the blower 90 further rotates as shown by arrow G, the portion 94 near the front side edge 93 of the throwing-up blade 56 is further elastically deformed rearward with respect to the rotation direction over the oblique edge 99 of the supporting member 91. The clearance S2 between the blower 90 and the inside peripheral surface 37*a* (see FIG. 8C) is changed to a clearance S3 larger than the foreign matter 80.

Figure 8E:
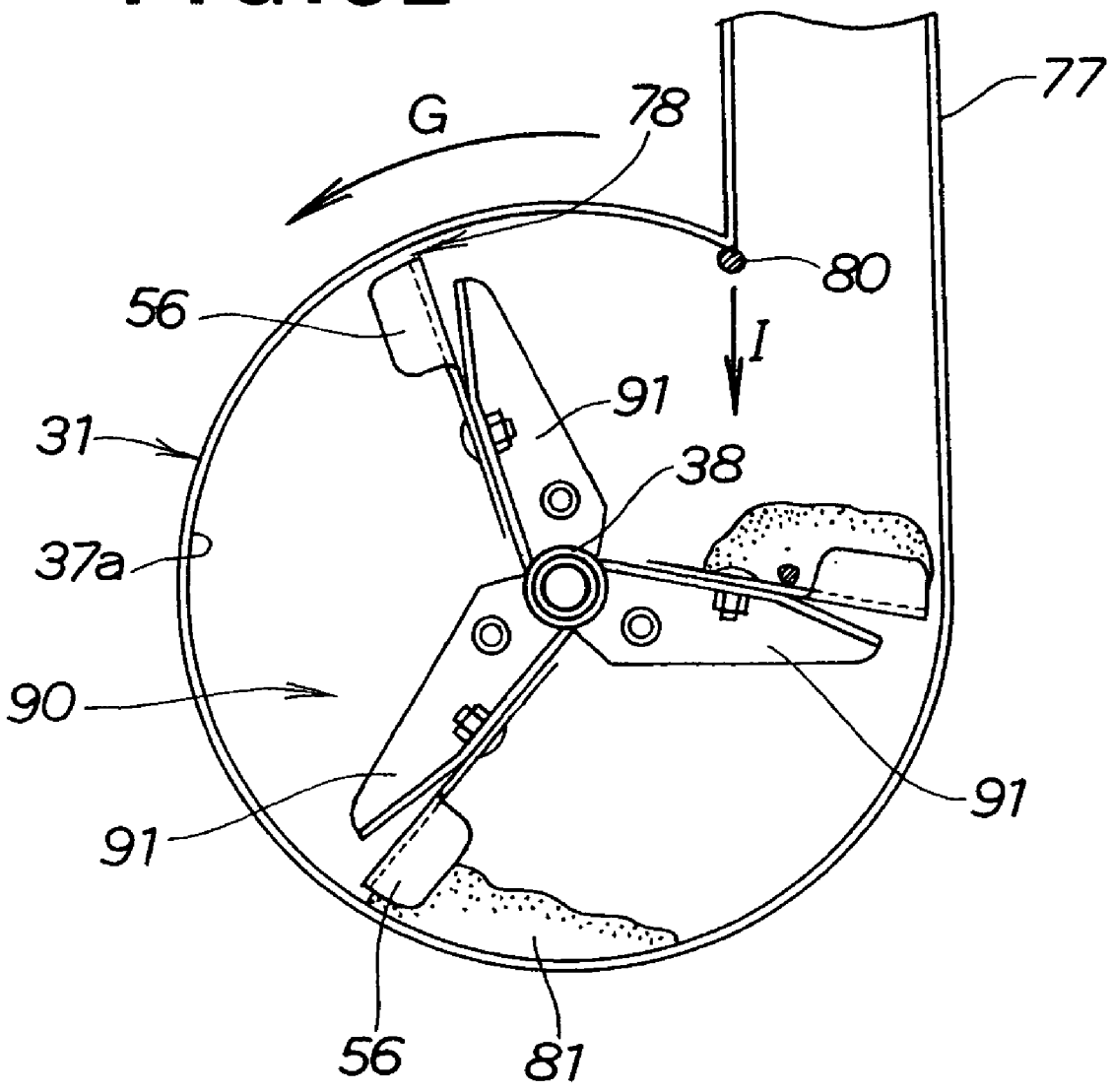

As shown in FIG. 8E, when the blower 90 is further rotated as shown by arrow G, the foreign matter 80 entering the gap 78 between the blower 90 and the inside peripheral surface 37*a* escapes from the gap 78, falling as shown by arrow I. The foreign matter 80 is prevented from being caught in the gap 78 between the blower 90 and the inside peripheral surface 37*a*.

Upon release of the foreign matter 80 from the gap 78, the throwing-up blade 56 is freed from the load applied by the foreign matter 80, returning to the original position by its elastic force. The blower 90 can thus rotate normally, continuing snow removing operation.

Figure 9:
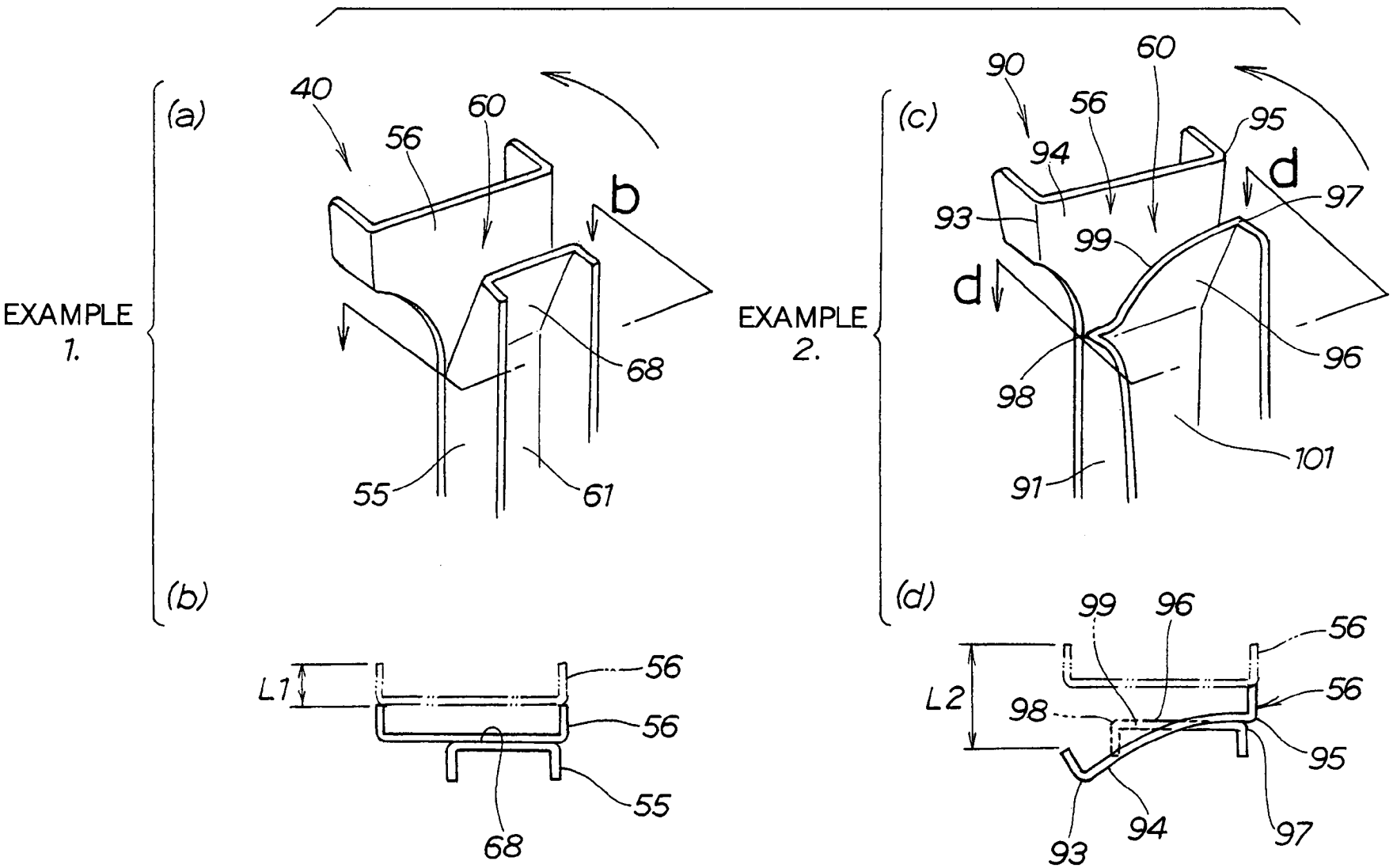
FIG. 9 is a diagram illustrating amounts of elastic deformation of a throwing-up blade according to the first embodiment and the second embodiment.
Figure 10:
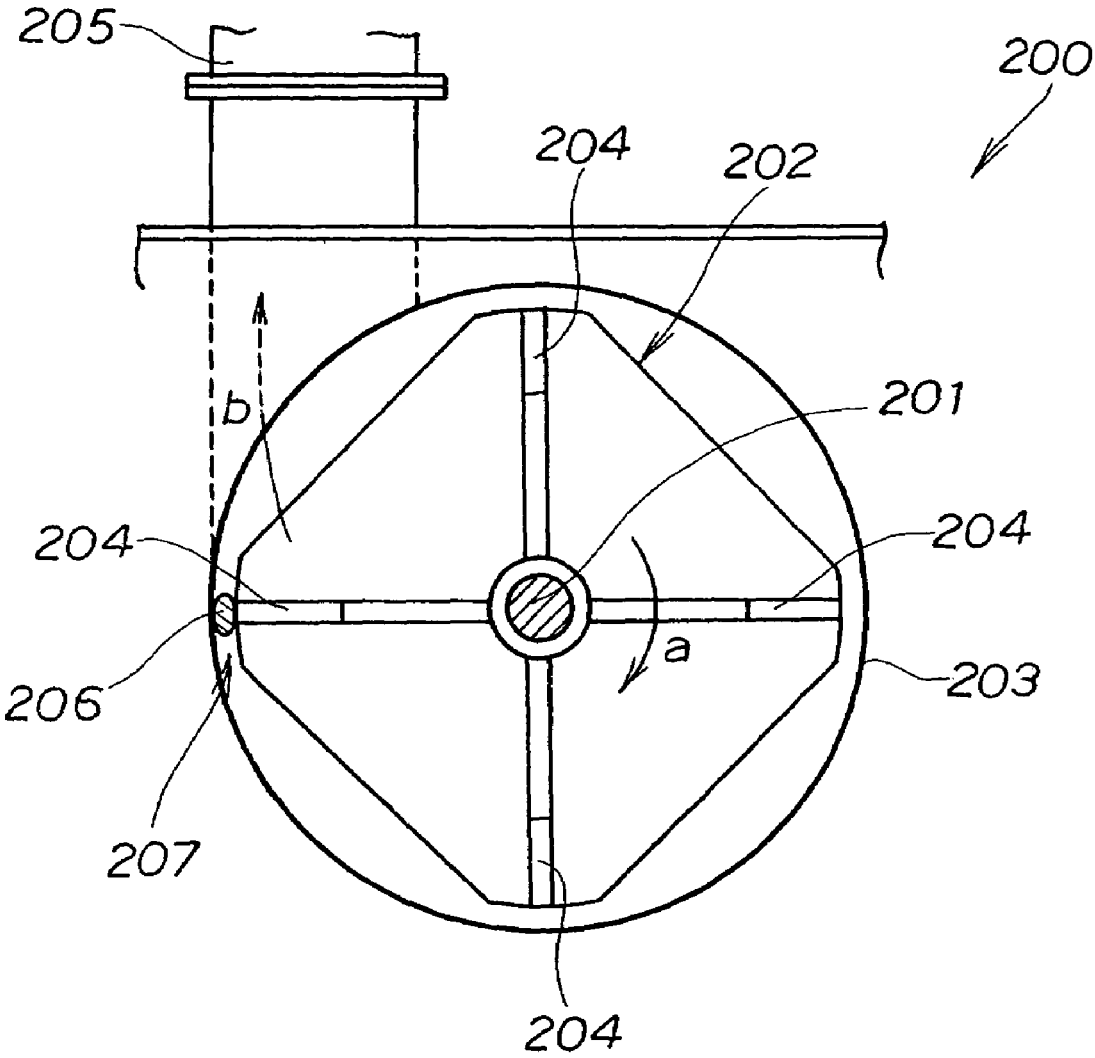
FIG. 10 (PRIOR ART)
FIG. 10 is a front view of a conventional blower for use in a snow removal machine.

FIG. 9(*a*) to (*d*), illustrates amounts of elastic deformation of the throwing-up blade 56 in the first and second embodiments according to the present invention, in which (*a*) and (*b*) illustrate the first embodiment and (c) and (*d*) illustrate the second embodiment.

As shown in (a), the distal end portion of the supporting portion 61 of the supporting member 55 in the first embodiment has the tapered portion 68 inclined rearward with respect to the rotation direction (arrow direction) of the blower 40, thereby forming the vacant space 60 between the throwing-up blade 56 and the tapered portion 68 to allow rearward elastic deformation of the throwing-up blade 56 with respect to the rotation direction.

Referring to (b), the throwing-up blade 56 is elastically deformed rearward with respect to the rotation direction from a position shown in imaginary lines to a position shown in solid lines by L1, abutting on the tapered portion 68. With this, as shown in FIG. 5C, the gap 78 between the blower 40 and the inside peripheral surface 37*a* is enlarged from S1 (see FIG. 5B) to S2, releasing the foreign matter 80 from the gap 78.

As shown in (c), the distal end portion of the supporting portion 101 of the supporting member 91 according to the second embodiment has the tapered portion 96 inclined rearward with respect to the rotation direction (arrow direction) of the blower 90, thereby forming the vacant space 60 between the throwing-up blade 56 and the tapered portion 96 to allow rearward elastic deformation of the throwing-up blade 56 with respect to the rotation direction. The tapered portion 96 of the supporting member 91 has the oblique edge 99 sloped downward from the rear side edge 97 to the front side edge 98.

As shown in (d), after elastically deformed rearward with respect to the rotation direction, abutting on the tapered portion 96, the throwing-up blade 56 is elastically deformed at the portion 94 near the front side edge 93 rearward with respect to the rotation direction by L2.

L1 and L2 shown in (b) and (d) have the relationship of L1<L2.

As described above, the portion 94 near the front side edge 93 of the throwing-up blade 56 is elastically deformed by a distance of L2 rearward with respect to the rotation direction, thereby widening the gap 78 between the blower 90 and the inside peripheral surface 37*a* from S2 (see FIG. 8C) to S3 as shown in FIG. 8D and releasing the foreign matter 80 from the gap 78. According to the second embodiment, a larger foreign matter 80 can be released from engagement than in the first embodiment.

The first and second embodiments have been described with the example of detachably attaching the throwing-up blade 56 to the supporting member 55, 91 with the bolts 57, 57 and the nuts 58, 58. Fastening means for detachably attaching the throwing-up blade 56 to the supporting member 55 is not limited to the bolts 57, 57 and the nuts 58, 58. Other fastening means may be used instead.

The shapes of the supporting members 55, 91 and the throwing-up blade 56 in the first and second embodiments are exemplarily illustrated and the present invention is not limited thereto.

The first and second embodiments have been described with the example in which the foreign matter 80 enters the gap 78 in the vicinity of the peripheral edge 82*a* of the opening 82 immediately after the throwing-up blade 56 throws up the snow 81 through the opening 82 into the tubular portion 77, which is not intended to be limiting. The same effect is obtained when the foreign matter 80 enters the gap 78 at any location between the blower 40 and the inside peripheral surface 37*a* of the blower housing 31.

The second embodiment has been described with the example in which the supporting member 91 has the tapered portion 96 and the tapered portion 96 is formed with the oblique edge 99 sloped downward from the rear side edge 97 to the front side edge 98, which is not intended to be limiting. It is also possible to form only the oblique edge 99 sloped downward from the rear side edge 97 to the front side edge 98 of the supporting member 91 without providing the tapered portion 96.

The second embodiment has been described with the example of forming the oblique edge 99 formed at the tapered portion 96 in a curved shape. The shape of the oblique edge 99 is not limited thereto and may be a linear oblique edge 99, for example.

The second embodiment has been described with the example of forming the tapered portion 96 with the oblique edge 99 sloped downward from the rear side edge 97 to the front side edge 98, which is not intended to be limiting. The tapered portion 96 may be formed with an oblique edge 99 sloped downward from the front side edge 98 to the rear side edge 97.

Obviously, various minor changes and modifications of the present invention are possible in the light of the above teaching. It is therefore to be understood that within the scope of the appended claims the invention may be practiced otherwise than as specifically described.

What is claimed is:

1. A snow removal machine, comprising:

an auger for collecting snow;

a blower provided in a blower housing for throwing up the collected snow;

a drive shaft for rotating the auger and the blower; and a chute for guiding the thrown-up snow for throwing the snow onto a desired location;

wherein the blower comprises a plurality of supporting members provided radially on the drive shaft and having flat distal end portions inclined in a direction opposite to a direction of rotation of the blower, and a plurality of resilient elastically deformable throwing-up blades having proximal end portions attached to the respective supporting members in the vicinity of the inclined flat distal end portions of the supporting members and blade bodies extending radially outward from the respective proximal end portions, each of the inclined flat distal end portions of the supporting members and a corresponding one of the blade bodies of the throwing-up blades defining therebetween a generally triangular space so as to allow the throwing-up blade to undergo bending only about the proximal end portion thereof while keeping the blade body free from deformation until the blade body comes in contact with the inclined flat distal end portion of the supporting member.

2. A snow removal machine as set forth in claim 1, wherein the throwing-up blades are detachably attached to the respective supporting members.

3. A snow removal machine as set forth in claim 1, wherein the inclined flat distal end portion of each supporting member is formed in a downward slope from a rear side edge to a front side edge or vice versa so that after the blade body of each throwing-up blade comes in contact with the inclined flat distal end portion of the corresponding supporting member, a front side edge or a rear side edge of the blade body is elastically deformable in a twisted state about the downward slope of the inclined flat distal end portion in the direction opposite to the direction of rotation of the blower.

4. A snow removal machine comprising:

an auger for collecting snow;

a blower provided in a blower housing for throwing up the collected snow;

a drive shaft for rotating the auger and the blower; and a chute for guiding the thrown-up snow for throwing the snow onto a desired location;

the blower comprising a plurality of supporting members provided radially on the drive shaft, and a plurality of elastically deformable throwing-up blades attached to the respective supporting members;

wherein a vacant space is formed between the supporting members and the throwing-up blades so as to allow elastic deformation of the throwing-up blades in a direction opposite to a direction of rotation, and wherein each supporting member has an opening for allowing snow left on the supporting member to fall therethrough after the throwing-up blade throws up snow.

5. A snow removal machine, comprising:

an auger for collecting snow;

a blower provided in a blower housing for throwing up the collected snow;

a drive shaft for rotating the auger and the blower; and a chute for guiding the thrown-up snow for throwing the snow onto a desired location;

wherein the blower comprises a plurality of supporting members provided radially on the drive shaft and having distal end portions inclined in a direction opposite to a direction of rotation of the blower, and a plurality of resilient elastically deformable throwing-up blades having proximal end portions attached to the respective supporting members in the vicinity of the inclined distal end portions of the supporting members and blade bodies extending radially outward from the respective proximal end portions, each of the inclined distal end portions of the supporting members and a corresponding one of the blade bodies of the throwing-up blades defining therebetween a generally triangular space so as to allow the throwing-up blade to undergo bending about the proximal end portion thereof while keeping the blade body free from deformation until the blade body comes in contact with the inclined distal end portion of the supporting member; and wherein each supporting member has an opening for allowing snow left on the supporting member to fall therethrough after the throwing-up blade throws up snow.

* * * * *